US011074869B2

(12) United States Patent
Chen

(10) Patent No.: US 11,074,869 B2
(45) Date of Patent: Jul. 27, 2021

(54) DISPLAY METHOD AND DISPLAY SYSTEM FOR ADJUSTING MOTION BLUR UNDER VARIOUS DISPLAY MODES

(71) Applicant: QISDA CORPORATION, Taoyuan (TW)

(72) Inventor: Min-Jye Chen, Taoyuan (TW)

(73) Assignee: Qisda Corporation, Taoyuan (TW)

( * ) Notice: Subject to any disclaimer, the term of this patent is extended or adjusted under 35 U.S.C. 154(b) by 94 days.

(21) Appl. No.: 16/671,196

(22) Filed: Nov. 1, 2019

(65) Prior Publication Data

US 2020/0143756 A1 May 7, 2020

(30) Foreign Application Priority Data

Nov. 7, 2018 (CN) ..... 201811320594.9

(51) Int. Cl.
*G09G 3/34* (2006.01)

(52) U.S. Cl.
CPC ..... *G09G 3/3406* (2013.01); *G09G 2310/08* (2013.01); *G09G 2320/0261* (2013.01); *G09G 2320/064* (2013.01); *G09G 2320/0633* (2013.01); *G09G 2320/10* (2013.01)

(58) Field of Classification Search
CPC combination set(s) only.
See application file for complete search history.

(56) References Cited

U.S. PATENT DOCUMENTS 9,019,194 B2 * 4/2015 Seo ..... G09G 3/342 345/102
2018/0233109 A1 * 8/2018 Lin ..... G09G 3/342
2019/0035344 A1 * 1/2019 Lin ..... G09G 3/3406
2020/0135149 A1 * 4/2020 Lin ..... G09G 3/3406

* cited by examiner

*Primary Examiner* — Robin J Mishler

(57) ABSTRACT

A display method includes selecting a display mode from a plurality of display modes, acquiring a data clock signal having a data period including a pixel active interval and a blank interval, and setting waveforms of a backlight driving signal within the pixel active interval and the blank interval according to the display mode in order to meet a motion blur effect corresponding to the display mode. A power ratio of the backlight driving signal within the blank interval to the backlight driving signal within the pixel active interval determines the motion blur effect. The waveforms of the backlight driving signal within the pixel active interval and the blank interval are different.

20 Claims, 4 Drawing Sheets

DISPLAY METHOD AND DISPLAY SYSTEM FOR ADJUSTING MOTION BLUR UNDER VARIOUS DISPLAY MODES

BACKGROUND OF THE INVENTION

1. Field of the Invention

The present invention illustrates a display method and a display system for adjusting motion blur, and more particularly, a display method and a display system for adjusting the motion blur by setting appropriate waveforms of a backlight driving signal.

2. Description of the Prior Art

Liquid crystal display (LCD) and organic light emitting diode (OLED) devices have been widely used in our daily life because they take advantages of thin appearance, low power consumption, and no radiation. For example, the LCD and OLED devices can be applied to multimedia players, mobile phones, personal digital assistants, computer monitors, or flat-screen TVs.

When a conventional display device displays an image, a pulse width modulation signal is used for driving a backlight source. The backlight source is constantly enabled to emit backlight (say, hold type display mode). Therefore, when a user watches a displayed image, the user easily feels that the displayed image is unstable, thereby reducing quality of visual experience. Particularly, when the conventional display device displays an image with high frame rate or with high motion objects, the displayed image is prone to introduce motion blur, thereby reducing quality of visual experience. Some advanced display devices can use a CRT-based (Cathode Ray Tube based) driving mode for driving their backlight sources according to an impulse waveform (say, impulse type display method). For example, the backlight source can be driven by a backlight driving signal with two times of original frequency, or can only be enabled within a blank interval of a vertical synchronous signal. However, although the backlight source can be driven according to the impulse waveform for reducing the motion blur, it results in a reduction of maximum supported display brightness level and results in an unstable image effect (i.e., especially in certain frames).

Further, when the user deals with a document process by using a static image display mode, if the display device reduces the motion blur too much, it results in presence of an over-contrast effect and an over-sharpness effect of the displayed image, leading to discomfort of human eyes. When the user plays a video game by using a dynamic image display mode, if the motion blur is too obvious, it results in an image delay and an image sticking effect, leading to visual quality reduction. In current display devices, no motion blur adjustment function is introduced under various display modes. Therefore, the displayed image cannot be optimized according to requirements of the user.

SUMMARY OF THE INVENTION

In an embodiment of the present invention, a display method for adjusting motion blur is disclosed. The display method comprises selecting a display mode from a plurality of display modes, acquiring a data clock signal having a data period comprising a pixel active interval and a blank interval, and setting waveforms of a backlight driving signal within the pixel active interval and the blank interval according to the display mode in order to meet a motion blur effect corresponding to the display mode. A power ratio of the backlight driving signal within the blank interval to the backlight driving signal within the pixel active interval determines the motion blur effect. The waveforms of the backlight driving signal within the pixel active interval and the blank interval are different.

In another embodiment of the present invention, a display system is disclosed. The display system comprises a display panel, a processor, a backlight driving device, a backlight switch, and a backlight device. The display panel is configured to display an image. The processor is coupled to the display panel and configured to adjust a display mode of the image. The backlight driving device is coupled to the processor and configured to generate a backlight driving signal according to the display mode. The backlight switch is coupled to the backlight driving device. The backlight device is coupled to the backlight switch. The backlight driving device controls the backlight switch for driving the backlight device according to the backlight driving signal. The processor acquires a data clock signal having a data period comprising a pixel active interval and a blank interval. After a display mode is selected from a plurality of display modes, the processor sets waveforms of the backlight driving signal within the pixel active interval and the blank interval according to the display mode in order to meet a motion blur effect corresponding to the display mode. A power ratio of the backlight driving signal within the blank interval to the backlight driving signal within the pixel active interval determines the motion blur effect. The waveforms of the backlight driving signal within the pixel active interval and the blank interval are different.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
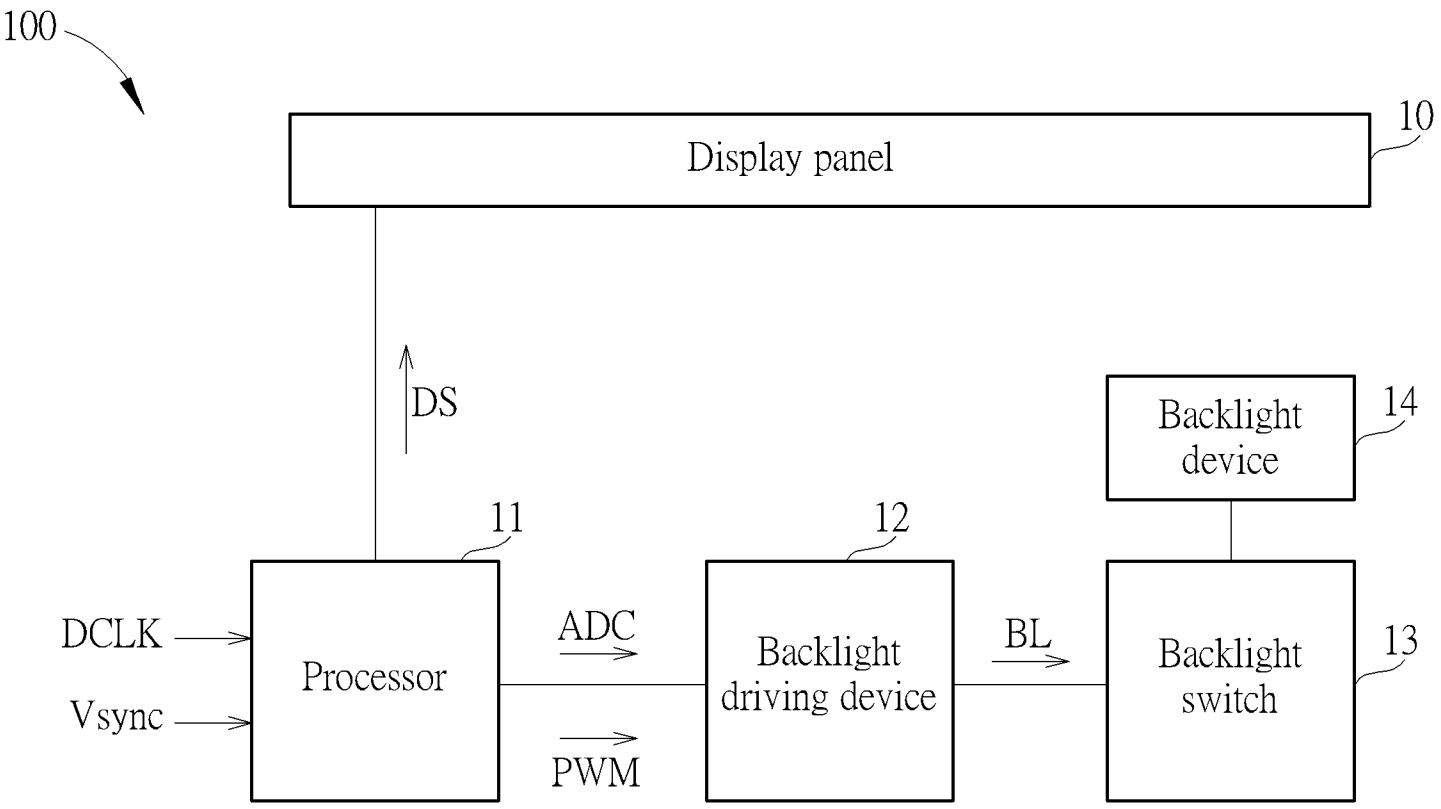
FIG. 1 is a structure of a display system according to the embodiment of the present invention.

FIG. 1 is a structure of a display system 100 according to the embodiment of the present invention. The display system 100 includes a display panel 10, a processor 11, a backlight driving device 12, a backlight switch 13, and a backlight device 14. The display panel 10 is used for displaying an image. The display panel 10 can be any type of display panels, such as a liquid crystal display (LCD) panel or an organic light emitting diode (OLED) display panel. The processor 11 is coupled to the display panel 10 for adjusting a display mode of the image. The processor 11 can be any internal or external pressing unit, such as a central processing unit, a microprocessor, or a processing chip (i.e., a Scaler IC). The processor 11 can control the display panel 10 to display a plurality of display modes for a user. Then, one of the display modes can be selected by the user. The backlight driving device 12 is coupled to the processor 11. The processor 11 can control the backlight driving device 12 to generate a backlight driving signal BL according to the display mode. For example, the processor 11 can control the display panel 10 to display options of a static image display mode and a dynamic image display mode. When the user selects the dynamic image display mode, the processor 11 can control the backlight driving device 12 to generate an appropriate backlight driving signal BL for the dynamic image display mode in order to greatly reduce the motion blur effect. When the user selects the static image display mode, the processor 11 can control the backlight driving device 12 to generate an appropriate backlight driving signal BL for the static image display mode in order to slightly reduce the motion blur effect and enhance brightness of the displayed image. The backlight switch 13 is coupled to the backlight driving device 12. The backlight switch 13 can be an active circuit formed by a current limiting resistor and a transistor switch. The backlight device 14 is coupled to the backlight switch 13. The backlight driving device 12 can control the backlight switch 13 for driving the backlight device 14 according to the backlight driving signal BL. The backlight device 14 can be a light-emitting diode array, an incandescent light bulb, an electroluminescent panel (ELP), or a cold cathode fluorescent lamp (CCFL). In the display system 100, the processor 11 can acquire a data clock signal DCLK having a data period including a pixel active interval and a blank interval. The pixel active interval and the blank interval can form a period of a vertical synchronous signal Vsync. The processor 11 can further acquire information of the display mode selected by the user. Then, the processor 11 can generate driving signals DS for driving pixels of the display panel 10. For example, the processor 11 can generate the driving signals DS including scanning line signals and data line signals to the display panel 10. A gate driving circuit and a data driving circuit can be used for controlling operations of the pixels of the display panel 10 according to the scanning line signals and the data line signals. Further, the processor 11 can generate a pulse width modulation signal PWM and a peak envelope signal ADC according to the display mode for setting waveforms of the backlight driving signal BL within the pixel active interval and the blank interval according to the display mode in order to meet the motion blur effect corresponding to the display mode. In other words, after the pulse width modulation signal PWM and the peak envelope signal ADC are received by the backlight driving device 12, the backlight driving signal BL can be generated according to the display mode. Therefore, after the backlight driving device 12 drives the backlight device 14 through the backlight switch 13 according to the backlight driving signal BL, the motion blur effect of the image displayed on the display panel 10 is consistent with the display mode. Further, the display system 100 is not limited to manually selecting the display mode. For example, in the display system 100, a display mode can be automatically selected according to a current video data stream. For example, when a frame rate of the current video data stream is greater than a threshold, the display system 100 can switch a current display mode to an appropriate display mode. Further, in the display system 100, a display mode can be automatically selected according to hardware specifications, software profiles, or program names for providing optimized visual experience. Any reasonable display mode selection method or technology modification falls into the scope of the present invention. In the display system 100, a power ratio of the backlight driving signal BL within the blank interval to the backlight driving signal within the pixel active interval determines the motion blur effect. The waveforms of the backlight driving signal BL within the pixel active interval and the blank interval are different. Details of setting the backlight driving signal BL and adjusting the motion blur effect of the display system 100 are illustrated below.

Figure 2:
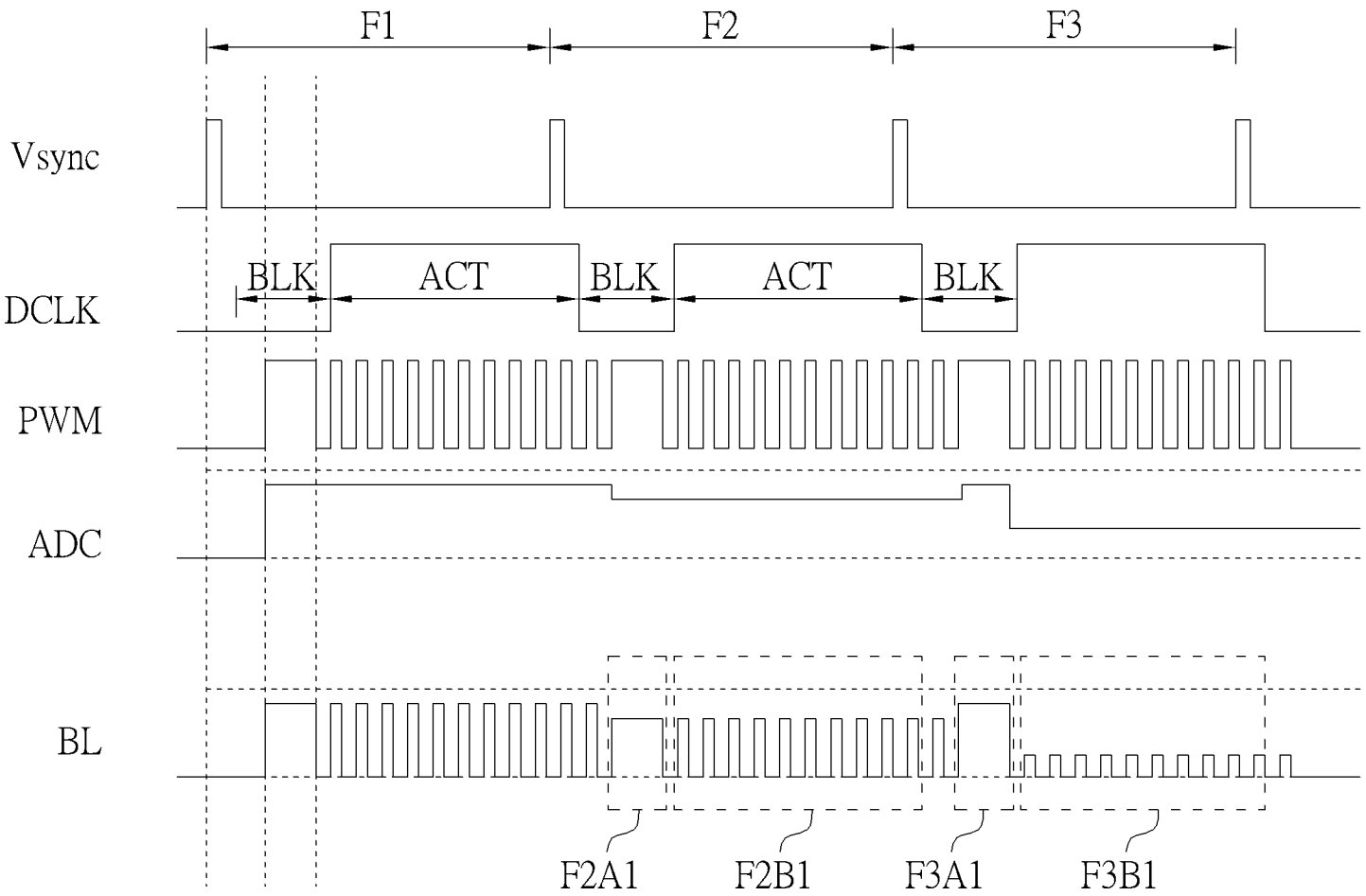
FIG. 2 is an illustration of a first correlation of a vertical synchronous signal, a data clock signal, a pulse width modulation signal, a peak envelope signal, and a backlight driving signal of the display system in FIG. 1.

FIG. 2 is an illustration of a first correlation of a vertical synchronous signal Vsync, a data clock signal DCLK, a pulse width modulation signal PWM, a peak envelope signal ADC, and a backlight driving signal BL of the display system 100. A period of the vertical synchronous signal Vsync can be denoted as a time length of one image frame displayed on the display panel 10. For example, the period of one image frame can include a time length of high voltage and a time length of low voltage of the vertical synchronous signal Vsync. In FIG. 2, the vertical synchronous signal Vsync is generated within intervals of a first frame F1, a second frame F2, and a third frame F3. The data clock signal DCLK can include a plurality of square waveforms. The data period of the data clock signal DCLK can be equal to the period of the vertical synchronous signal Vsync. For example, when a display frequency (or say, a frame rate) is set to 60 Hertz, the data period is equal to 1/60 seconds. Further, the data period of the data clock signal DCLK includes a pixel active interval ACT and a blank interval BLK. A time interval of the data period of the data clock signal DCLK and a time interval of the period of the vertical synchronous signal Vsync can be identical, or can be slightly different by introducing a slight delay. The pixels of the display panel 10 are transient within the pixel active interval ACT. The pixels of the display panel 10 are steady within the blank interval BLK. The processor 11 can generate the pulse width modulation signal PWM according to the display mode. The pulse width modulation signal PWM can include a plurality of pulse signals. Therefore, the pulse width modulation signal PWM has two alternating voltage levels. The processor 11 can generate the peak envelope signal ADC according to the display mode. Particularly, the peak envelope signal ADC can be regarded as an envelope signal corresponding to an amplitude variation of the backlight driving signal BL. Therefore, the processor 11 can control the backlight driving device 12 for generating the backlight driving signal BL according to the pulse width modulation signal PWM and the peak envelope signal ADC. Further, a frequency variation of the backlight driving signal BL within the pixel active interval ACT and the blank interval BLK is consistent with the pulse width modulation signal PWM. An amplitude variation of the backlight driving signal BL within the pixel active interval ACT and the blank interval BLK is consistent with the peak envelope signal ADC. Several configuration modes of the backlight driving signal BL are illustrated below.

In a first configuration mode, the processor 11 can control the backlight driving device 12 for setting a first amplitude of the backlight driving signal BL within the pixel active interval ACT and setting a second amplitude of the backlight driving signal BL within the blank interval BLK in order to meet the motion blur effect corresponding to the display mode. As shown in FIG. 2, a waveform F2A1 of the backlight driving signal BL has the second amplitude within the blank interval BLK of the second frame F2. A waveform F2B1 of the backlight driving signal BL has the first amplitude within the pixel active interval ACT of the second frame F2. The second amplitude can be greater than, equal to, or smaller than the first amplitude. For example, for the second frame F2, the second amplitude of the waveform F2A1 is equal to the first amplitude of the waveform F2B1. For the third frame F3, the second amplitude of a waveform F3A1 is greater than the first amplitude of a waveform F3B1. Further, as previously mentioned, the amplitude variation of the backlight driving signal BL is consistent with the peak envelope signal ADC. The backlight driving signal BL with the first amplitude has a first power (i.e., an integral area) within the pixel active interval ACT. The backlight driving signal BL with the second amplitude has a second power within the blank interval BLK. A power ratio of the second power to the first power in a dynamic image display mode is greater than a power ratio of the second power to the first power in a static image display mode. For example, in the third frame F3, since the second amplitude of the waveform F3A1 is greater than the first amplitude of the waveform F3B1, a power ratio of the second power to the first power in the third frame F3 is greater than power ratios in the first frame F1 and the second frame F2. Here, the power ratio is defined as a ratio of a backlight driving signal power within the blank interval BLK to a backlight driving signal power within the active interval ACT. When the display system 100 uses the backlight driving signal BL with large power ratio for all frames, the motion blur effect can be reduced, leading to improving visual quality under the dynamic image display mode.

As previously mentioned, the CRT-based (Cathode Ray Tube based) driving mode for driving the backlight device 14 according to an impulse waveform (say, impulse type display method) can reduce the motion blur effect. Therefore, in the display system 100, when a power distribution of the backlight driving signal BL is similar to a power distribution of the impulse waveform, the motion blur effect can be greatly reduced. However, when the user deals with the document process by using the static image display mode, if the display device reduces the motion blur effect too much, it results in presence of an over-contrast effect and an over-sharpness effect of the displayed image, leading to discomfort of human eyes. When the user plays a video game by using the dynamic image display mode, if the motion blur effect is too strong, it results in an image delay effect and an image sticking effect, leading to visual quality reduction. Therefore, in the display system 100, the first amplitude of the backlight driving signal BL within a part of pixel active interval ACT and the second amplitude of the backlight driving signal BL within a part of blank interval BLK can be customized for adjusting the power distribution of the backlight driving signal BL during at least one frame. In other words, the display system 100 can provide satisfactory visual experience of the displayed images with different brightness or frequencies according to requirements of the user.

Figure 3:
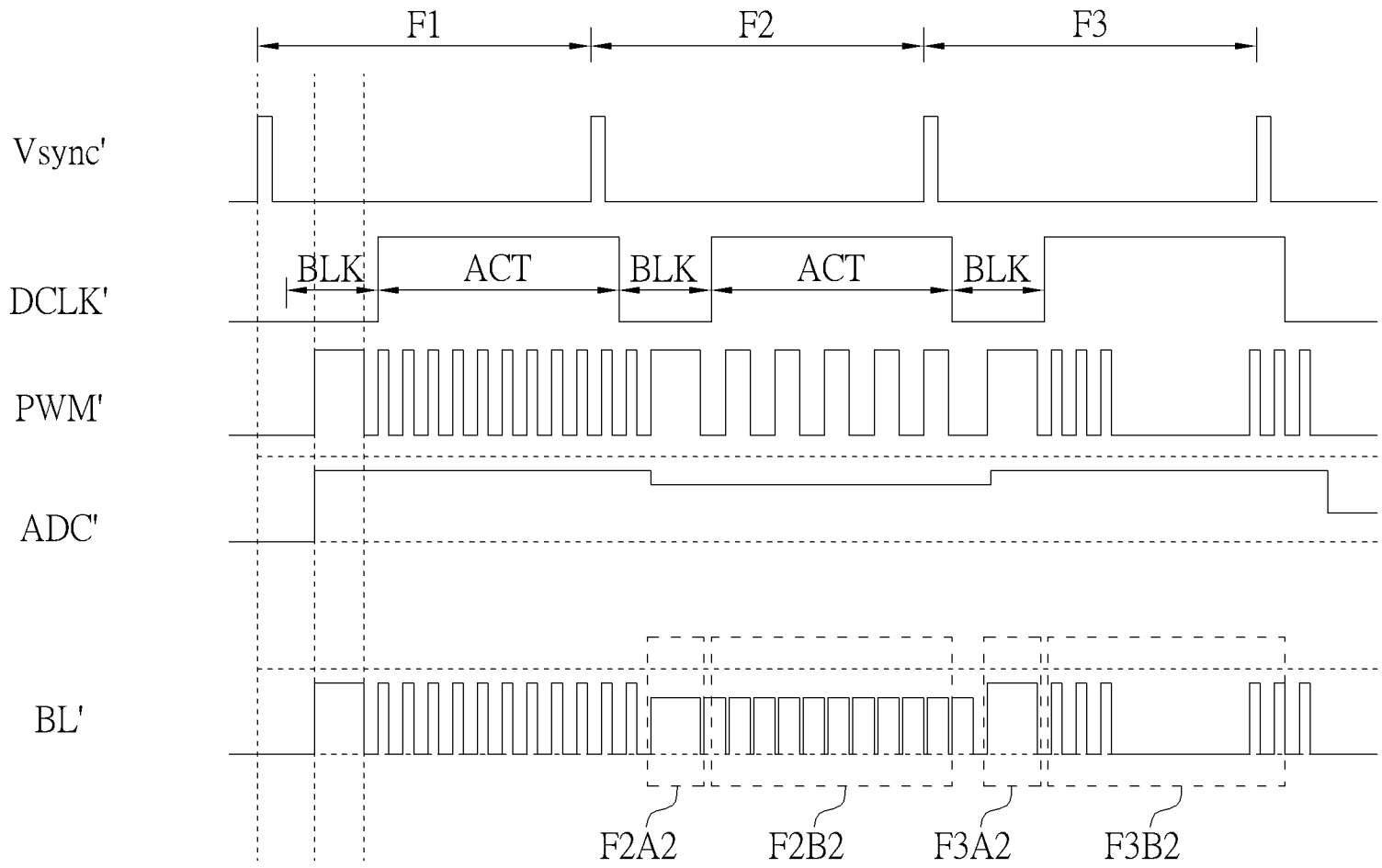
FIG. 3 is an illustration of a second correlation of a vertical synchronous signal, a data clock signal, a pulse width modulation signal, a peak envelope signal, and a backlight driving signal of the display system in FIG. 1.

FIG. 3 is an illustration of a second correlation of a vertical synchronous signal Vsync', a data clock signal DCLK', a pulse width modulation signal PWM', a peak envelope signal ADC', and a backlight driving signal BL' of the display system 100. Here, definitions of the vertical synchronous signal Vsync', the data clock signal DCLK', the pulse width modulation signal PWM', the peak envelope signal ADC', and the backlight driving signal BL' are similar to FIG. 2. Thus, their details are omitted. In a second configuration mode, the processor 11 can control the backlight driving device 12 for setting a first duty cycle of the backlight driving signal BL' within the pixel active interval ACT and setting a second duty cycle of the backlight driving signal BL' within the blank interval BLK in order to meet the motion blur effect corresponding to the display mode. As shown in FIG. 3, a waveform F2A2 of the backlight driving signal BL' has the second duty cycle within the blank interval BLK of the second frame F2. A waveform F2B2 of the backlight driving signal BL' has the first duty cycle within the pixel active interval ACT of the second frame F2. The second duty cycle can be greater than, equal to, or smaller than the first duty cycle. As previously mentioned, the amplitude variation of the backlight driving signal BL' is consistent with the peak envelope signal ADC'. The backlight driving signal BL' with the first duty cycle has a third power within the pixel active interval ACT. The backlight driving signal BL' with the second duty cycle has a fourth power within the blank interval BLK. A power ratio of the fourth power to the third power in the dynamic image display mode is greater than a power ratio of the fourth power to the third power in the static image display mode. For example, for the backlight driving signal BL' with a fixed waveform F2A2 in the second frame F2, when the first duty cycle of the waveform F2B2 is large, a power ratio of the fourth power to the third power for the second frame F2 is small. Conversely, for the backlight driving signal BL' with the fixed waveform F2A2 in the second frame F2, when the first duty cycle of the waveform F2B2 is small, a power ratio of the fourth power to the third power for the second frame F2 is large. Therefore, in the display system 100, the first duty cycle of the backlight driving signal BL' within a part of pixel active interval ACT and the second duty cycle of the backlight driving signal BL' within a part of blank interval BLK can be customized for adjusting the power distribution of the backlight driving signal BL' during at least one frame (i.e., such as the second frame F2). In other words, the display system 100 can provide satisfactory visual experience of the displayed images.

As previously mentioned, in the display system 100, when the power distribution of the backlight driving signal BL' is similar to the power distribution of the impulse waveform, the motion blur effect can be greatly reduced. However, when the user deals with the document process by using the static image display mode, if the display device reduces the motion blur effect too much, it results in presence of an over-contrast effect and an over-sharpness effect of the displayed image, leading to discomfort of human eyes. When the user plays the video game by using the dynamic image display mode, if the motion blur effect is too strong, it results in an image delay effect and an image sticking effect, leading to visual quality reduction. Therefore, in the display system 100, the first duty cycle of the backlight driving signal BL' within a part of pixel active interval ACT and the second duty cycle of the backlight driving signal BL' within a part of blank interval BLK can be customized for adjusting the power distribution of the backlight driving signal BL' during at least one frame. In other words, the display system 100 can provide satisfactory visual experience of the displayed images with different brightness or frequencies according to requirements of the user.

In FIG. 3, since the display system 100 can use the peak envelope signal ADC' for setting the amplitude variation of the backlight driving signal BL', a third configuration mode can be introduced for simultaneously adjusting two amplitudes and two duty cycles of the backlight driving signal BL' within a part of pixel active interval ACT and a part of blank interval BLK. For example, the processor 11 can control the backlight driving device 12 for setting a third amplitude and a third duty cycle of the backlight driving signal BL' within the pixel active interval ACT (i.e., the waveform F2B2) and setting a fourth amplitude and a fourth duty cycle of the backlight driving signal BL' within the blank interval BLK (i.e., the waveform F2A2) in order to meet the motion blur effect corresponding to the display mode. In other words, the "amplitude" and the "duty cycle" can be regarded as two adjustable parameters of the backlight driving signal BL'. In the third configuration mode, both amplitude and duty cycle of the backlight driving signal BL' can be configured in the second frame F2. Here, the backlight driving signal BL' with the third amplitude and the third duty cycle has a fifth power within the pixel active interval ACT (i.e., the waveform F2B2). The backlight driving signal BL' with the fourth amplitude and the fourth duty cycle has a sixth power within the blank interval BLK (i.e., the waveform F2A2). A power ratio of the sixth power to the fifth power in the dynamic image display mode is greater than a power ratio of the sixth power to the fifth power in the static image display mode. In the display system 100, when a power distribution of the backlight driving signal BL' is similar to a power distribution of the impulse waveform, the motion blur effect can be greatly reduced. However, when the user deals with the document process by using the static image display mode, if the display device reduces the motion blur effect too much, it results in presence of an over-contrast effect and an over-sharpness effect of the displayed image, leading to discomfort of human eyes. When the user plays the video game by using the dynamic image display mode, if the motion blur effect is too strong, it results in an image delay effect and an image sticking effect, leading to visual quality reduction. Therefore, in the display system 100, the third amplitude and the third duty cycle of the backlight driving signal BL' within a part of pixel active interval ACT, and the fourth amplitude and the fourth duty cycle of the backlight driving signal BL' within a part of blank interval BLK can be customized for adjusting the power distribution of the backlight driving signal BL' during at least one frame. In other words, the display system 100 can provide satisfactory visual experience of the displayed images with different brightness or frequencies according to requirements of the user.

In FIG. 3, in a fourth configuration mode, the processor 11 can control the backlight driving device 12 for setting a first enabling time length of the backlight driving signal BL' within the pixel active interval ACT and setting a second enabling time length of the backlight driving signal BL' within the blank interval BLK in order to meet the motion blur effect corresponding to the display mode. Here, the "enabling time length" is defined as a time length of enabling the backlight device 14. In FIG. 3, in the third frame F3, the backlight driving signal BL' within the blank interval BLK has the second enabling time length (i.e., a total time length corresponding to "high" amplitude of a waveform F3A2). The backlight driving signal BL' within the pixel active interval ACT has the first enabling time length (i.e., a total time length corresponding to "high" amplitude of a waveform F3B2). For example, the waveform F3B2 can be formed by several pulse signals. When the duty cycles of these pulse signals are fixed, an amount of the pulse signals is proportional to the total time length corresponding to "high" amplitude of the waveform F3B2. The second enabling time length can be greater than, equal to, or smaller than the first enabling time length. In FIG. 3, the first enabling time length of the waveform F3B2 is smaller than the first enabling time length of the backlight driving signal BL' within the pixel active interval ACT in the first frame F1. In the third frame F3, the backlight driving signal BL' with the first enabling time length has a seventh power within the pixel active interval ACT (i.e., the waveform F3B2). The backlight driving signal BL' with the second enabling time length has an eighth power within the blank interval BLK (i.e., the waveform F3A2). A power ratio of the eighth power to the seventh power in the dynamic image display mode is greater than a power ratio of the eighth power to the seventh power in the static image display mode. As previously mentioned, a power ratio is defined as a power of the backlight driving signal BL' within the blank interval BLK to a power of the backlight driving signal BL' within the pixel active interval ACT. When the display system 100 uses the backlight driving signal BL' with a large power ratio for all frames, the motion blur effect can be reduced, leading to improved visual quality under the dynamic image display mode. Similarly, in the display system 100, when the power distribution of the backlight driving signal BL' is similar to the power distribution of the impulse waveform, the motion blur effect can be greatly reduced. When the user deals with the document process by using the static image display mode, if the display device reduces the motion blur effect too much, it results in presence of an over-contrast effect and an over-sharpness effect of the displayed image, leading to discomfort of human eyes. When the user plays the video game by using the dynamic image display mode, if the motion blur effect is too strong, it results in an image delay effect and an image sticking effect, leading to visual quality reduction. Therefore, in the display system 100, the first enabling time length of the backlight driving signal BL' within the pixel active interval ACT and the second enabling time length of the backlight driving signal BL' within the blank interval BLK can be customized for adjusting the power distribution of the backlight driving signal BL' during at least one frame. Therefore, the display system 100 can provide satisfactory visual experience of the displayed images with different brightness or frequencies according to requirements of the user.

In the display system 100, the first configuration mode, the second configuration mode, the third configuration mode, and the fourth configuration mode can be used for setting the power distribution of the backlight driving signal during at least one frame. Further, any reasonable method for combining the first configuration mode, the second configuration mode, the third configuration mode, and the fourth configuration mode can be applied to the display system 100. For example, the amplitude, the duty cycle, and the enabling time length of the backlight driving signal can be simultaneously adjusted. In other words, when the first configuration mode, the second configuration mode, the third configuration mode, and the fourth configuration mode are appropriately combined for setting the power distribution of the backlight driving signal, the display system 100 can provide optimal motion blur effect for the display mode. Any configuration mode or combination technology falls into the scope of the present invention.

Figure 4:
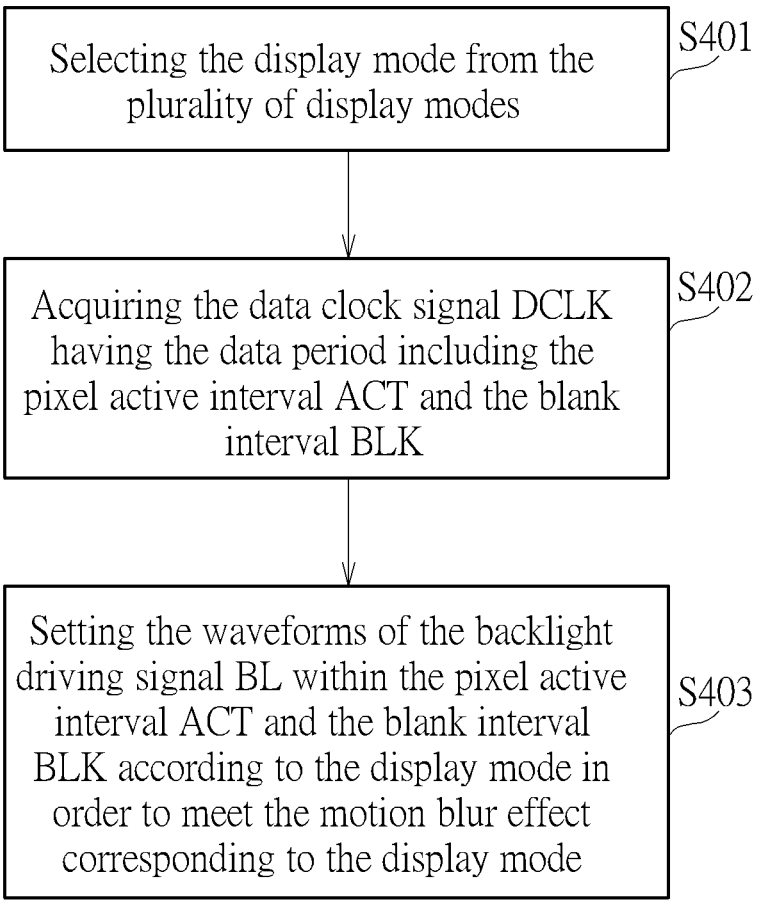
FIG. 4 is a flowchart of a display method for adjusting motion blur performed by the display system in FIG. 1.

FIG. 4 is a flow chart of a display method for adjusting motion blur performed by the display system 100. The display method for adjusting the motion blur includes step S401 to step S403. Any reasonable modification in step S401 to step S403 falls into the scope of the present invention. Step S401 to step S403 are illustrated below.

step S401: selecting the display mode from the plurality of display modes;

step S402: acquiring the data clock signal DCLK having the data period including the pixel active interval ACT and the blank interval BLK;

step S403: setting the waveforms of the backlight driving signal BL within the pixel active interval ACT and the blank interval BLK according to the display mode in order to meet the motion blur effect corresponding to the display mode.

Details of step S401 to step S403 are previously illustrated. Thus, they are omitted here. In the display system 100, the display panel 10 can display a configuration interface. For example, the display panel 10 can use an on-screen-display (OSD) function for displaying the configuration interface. Further, the configuration interface can include options of a plurality of display modes, such as the static image display mode and the dynamic image display mode. When the user deals with the document process by using the display system 100, the static image display mode can be selected. When the user plays the video game by using the display system 100, the dynamic image display mode can be selected. No matter what mode is selected by the user, the display system 100 can provide satisfactory visual experience of the displayed images.

Further, the display system 100 can use any reasonable method for setting the backlight driving signal BL. For example, the display system 100 can set waveforms of the backlight driving signal BL according to picture brightness weighting values. In practice, the display system 100 can acquire the picture brightness weighting values such as 100, 50, and 20 over time. Then, the display system 100 can generate a peak envelope signal ADC and a pulse width modulation signal PWM according to the picture brightness weighting values. Further, the backlight driving signal BL can be generated according to the peak envelope signal ADC and the pulse width modulation signal PWM. As previously mentioned, the CRT-based (Cathode Ray Tube based) driving mode for driving the backlight device 14 according to the impulse waveform (say, impulse type display method) can reduce the motion blur effect. Therefore, in the display system 100, when the power distribution of the backlight driving signal BL is similar to the power distribution of the impulse waveform, the motion blur effect can be greatly reduced. However, since the display system 100 is capable of setting the backlight driving signal BL, the display system 100 can constantly enable the backlight device 14 over time by using the hold type display mode. For example, in the second configuration mode (i.e., adjusting the duty cycle), when the display system 100 sets the duty cycle of the backlight driving signal equal to 100%, the backlight device 14 can be constantly enabled for displaying non-flickering images. In other words, an enabling time length, brightness intensity, and a flickering frequency of the backlight device 14 can be configured by the display system 100. Therefore, the display system 100 can provide satisfactory visual experience.

To sum up, the present invention discloses a display method and a display system for adjusting motion blur under various display modes. The display system can provide satisfactory quality of displayed images according to a display mode selected by a user. The display system can set an appropriate backlight driving signal for adjusting the motion blur effect on the displayed images. When a power distribution of the backlight driving signal is similar to a power distribution of the impulse waveform, the motion blur effect can be greatly reduced. When a total power of the backlight driving signal is large, the display system can display images with high brightness. Further, the display system can optimize the power distribution of the backlight driving signal by adjusting the amplitude, the duty cycle, and/or the enabling time length of the backlight driving signal during at least one frame. Therefore, the display system can provide satisfactory visual experience of the displayed images with different brightness or frequencies according to requirements of the user.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A display method for adjusting motion blur comprising:

selecting a display mode from a plurality of display modes;

acquiring a data clock signal having a data period comprising a pixel active interval and a blank interval; and setting waveforms of a backlight driving signal within the pixel active interval and the blank interval according to the display mode in order to meet a motion blur effect corresponding to the display mode;

wherein a power ratio of the backlight driving signal within the blank interval to the backlight driving signal within the pixel active interval determines the motion blur effect, and the waveforms of the backlight driving signal within the pixel active interval and the blank interval are different.

2. The method of claim 1, wherein setting the waveforms of the backlight driving signal within the pixel active interval and the blank interval according to the display mode in order to meet the motion blur effect corresponding to the display mode, is setting a first amplitude of the backlight driving signal within the pixel active interval and setting a second amplitude of the backlight driving signal within the blank interval in order to meet the motion blur effect corresponding to the display mode.

3. The method of claim 2, wherein the backlight driving signal with the first amplitude has a first power within the pixel active interval, the backlight driving signal with the second amplitude has a second power within the blank interval, and a power ratio of the second power to the first power in a dynamic image display mode is greater than a power ratio of the second power to the first power in a static image display mode.

4. The method of claim 1, wherein setting the waveforms of the backlight driving signal within the pixel active interval and the blank interval according to the display mode in order to meet the motion blur effect corresponding to the display mode, is setting a first duty cycle of the backlight driving signal within the pixel active interval and setting a second duty cycle of the backlight driving signal within the blank interval in order to meet the motion blur effect corresponding to the display mode.

5. The method of claim 4, wherein the backlight driving signal with the first duty cycle has a third power within the pixel active interval, the backlight driving signal with the second duty cycle has a fourth power within the blank interval, and a power ratio of the fourth power to the third power in a dynamic image display mode is greater than a power ratio of the fourth power to the third power in a static image display mode.

6. The method of claim 1, wherein setting the waveforms of the backlight driving signal within the pixel active interval and the blank interval according to the display mode in order to meet the motion blur effect corresponding to the display mode, is setting a third amplitude and a third duty cycle of the backlight driving signal within the pixel active interval and setting a fourth amplitude and a fourth duty cycle of the backlight driving signal within the blank interval in order to meet the motion blur effect corresponding to the display mode.

7. The method of claim 6, wherein the backlight driving signal with the third amplitude and the third duty cycle has a fifth power within the pixel active interval, the backlight driving signal with the fourth amplitude and the fourth duty cycle has a sixth power within the blank interval, and a power ratio of the sixth power to the fifth power in a dynamic image display mode is greater than a power ratio of the sixth power to the fifth power in a static image display mode.

8. The method of claim 1, wherein setting the waveforms of the backlight driving signal within the pixel active interval and the blank interval according to the display mode in order to meet the motion blur effect corresponding to the display mode, is setting a first enabling time length of the backlight driving signal within the pixel active interval and setting a second enabling time length of the backlight driving signal within the blank interval in order to meet the motion blur effect corresponding to the display mode.

9. The method of claim 8, wherein the backlight driving signal with the first enabling time length has a seventh power within the pixel active interval, the backlight driving signal with the second enabling time length has an eighth power within the blank interval, and a power ratio of the eighth power to the seventh power in a dynamic image display mode is greater than a power ratio of the eighth power to the seventh power in a static image display mode.

10. The method of claim 1, further comprising:

generating a pulse width modulation signal by a processor according to the display mode;

generating a peak envelope signal by a processor according to the display mode; and generating the backlight driving signal according to the pulse width modulation signal and the peak envelope signal;

wherein a frequency variation of the backlight driving signal within the pixel active interval and the blank interval is consistent with the pulse width modulation signal, and an amplitude variation of the backlight driving signal within the pixel active interval and the blank interval is consistent with the peak envelope signal.

11. A display system comprising:

a display panel configured to display an image;

a processor coupled to the display panel and configured to adjust a display mode of the image;

a backlight driving device coupled to the processor and configured to generate a backlight driving signal according to the display mode;

a backlight switch coupled to the backlight driving device; and a backlight device coupled to the backlight switch;

wherein the backlight driving device controls the backlight switch for driving the backlight device according to the backlight driving signal, the processor acquires a data clock signal having a data period comprising a pixel active interval and a blank interval, after a display mode is selected from a plurality of display modes, the processor sets waveforms of the backlight driving signal within the pixel active interval and the blank interval according to the display mode in order to meet a motion blur effect corresponding to the display mode, a power ratio of the backlight driving signal within the blank interval to the backlight driving signal within the pixel active interval determines the motion blur effect, and the waveforms of the backlight driving signal within the pixel active interval and the blank interval are different.

12. The system of claim 11, wherein the processor controls the backlight driving device for setting a first amplitude of the backlight driving signal within the pixel active interval and setting a second amplitude of the backlight driving signal within the blank interval in order to meet the motion blur effect corresponding to the display mode.

13. The system of claim 12, wherein the backlight driving signal with the first amplitude has a first power within the pixel active interval, the backlight driving signal with the second amplitude has a second power within the blank interval, and a power ratio of the second power to the first power in a dynamic image display mode is greater than a power ratio of the second power to the first power in a static image display mode.

14. The system of claim 11, wherein the processor controls the backlight driving device for setting a first duty cycle of the backlight driving signal within the pixel active interval and setting a second duty cycle of the backlight driving signal within the blank interval in order to meet the motion blur effect corresponding to the display mode.

15. The system of claim 14, wherein the backlight driving signal with the first duty cycle has a third power within the pixel active interval, the backlight driving signal with the second duty cycle has a fourth power within the blank interval, and a power ratio of the fourth power to the third power in a dynamic image display mode is greater than a power ratio of the fourth power to the third power in a static image display mode.

16. The system of claim 11, wherein the processor controls the backlight driving device for setting a third amplitude and a third duty cycle of the backlight driving signal within the pixel active interval and setting a fourth amplitude and a fourth duty cycle of the backlight driving signal within the blank interval in order to meet the motion blur effect corresponding to the display mode.

17. The system of claim 16, wherein the backlight driving signal with the third amplitude and the third duty cycle has a fifth power within the pixel active interval, the backlight driving signal with the fourth amplitude and the fourth duty cycle has a sixth power within the blank interval, and a power ratio of the sixth power to the fifth power in a dynamic image display mode is greater than a power ratio of the sixth power to the fifth power in a static image display mode.

18. The system of claim 11, wherein the processor controls the backlight driving device for setting a first enabling time length of the backlight driving signal within the pixel active interval and setting a second enabling time length of the backlight driving signal within the blank interval in order to meet the motion blur effect corresponding to the display mode.

19. The system of claim 18, wherein the backlight driving signal with the first enabling time length has a seventh power within the pixel active interval, the backlight driving signal with the second enabling time length has an eighth power within the blank interval, and a power ratio of the eighth power to the seventh power in a dynamic image display mode is greater than a power ratio of the eighth power to the seventh power in a static image display mode.

20. The system of claim 11, wherein the processor generates a pulse width modulation signal and a peak envelope signal according to the display mode, controls the backlight driving device for generating the backlight driving signal according to the pulse width modulation signal and the peak envelope signal, a frequency variation of the backlight driving signal within the pixel active interval and the blank interval is consistent with the pulse width modulation signal, and an amplitude variation of the backlight driving signal within the pixel active interval and the blank interval is consistent with the peak envelope signal.

* * * * *